US006708975B1

(12) United States Patent
Fox et al.

(10) Patent No.: US 6,708,975 B1
(45) Date of Patent: Mar. 23, 2004

(54) MULTI-FORMAT POKER GAME

(76) Inventors: John W. Fox, 5002 S. 39th St., Omaha, NE (US) 68107; Michael W. Wood, 11831 Wentling Ave., Suite #C, Baton Rouge, LA (US) 70816

( * ) Notice: Subject to any disclaimer, the term of this patent is extended or adjusted under 35 U.S.C. 154(b) by 343 days.

(21) Appl. No.: 09/398,891

(22) Filed: Sep. 20, 1999

(51) Int. Cl.[7] ..... A63F 1/00

(52) U.S. Cl. ..... 273/292; 273/274; 463/13; 463/20

(58) Field of Search ..... 273/292, 274; 463/13, 20

(56) References Cited

U.S. PATENT DOCUMENTS 5,356,140 A * 10/1994 Dabrowski et al. ..... 273/85 CP
5,803,809 A * 9/1998 Yoseloff ..... 463/13
5,816,915 A 10/1998 Kadlic ..... 463/13
5,823,873 A * 10/1998 Moody ..... 463/13
5,882,259 A * 3/1999 Holmes, Jr. et al. ..... 463/13
6,007,066 A * 12/1999 Moody ..... 273/292
6,089,977 A * 7/2000 Bennett ..... 463/20

* cited by examiner

*Primary Examiner*—Benjamin H. Layno
*Assistant Examiner*—Dolores Collins
(74) *Attorney, Agent, or Firm*—Joan Edward Roethel

(57) ABSTRACT

A card game is preferably played on an electronic video gaming machine in which a single player plays against a pay table. The player makes a wager for each of two or more hands that the player wishes to play. The player selects a poker hand format for each hand, with no two hands having the same poker hand format. After the player has made his wagers and selected the poker hand format for each hand, the computer controls deal out face up each initial five card hand of poker in each poker format selected by the player. The player selects none, one or more of the face up cards from each hand as cards to be held. The non-selected cards are discarded from each first hand and replacement cards are dealt face for each discarded card. The poker hand ranking of the resulting final five cards of each hand are then determined. The player is then paid a preestablished amount based on the amount of each wager if the resulting cards of each hand comprise a predetermined poker hand ranking.

15 Claims, 2 Drawing Sheets

MULTI-FORMAT POKER GAME

This invention relates primarily to an electronic video poker machine, and more particularly to an electronic video poker machine that is programmed to provide multiple video poker formats to the player. The player may play different types of video poker formats at the same time using multiple hands with varying wagering amounts.

BACKGROUND OF THE INVENTION

There have been many types of electronic video gaming machines that have been developed. The electronic video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard 52 card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand. In video Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks or Better. A payout table is established based on the number of coins wagered by the player and the type of poker hand achieved.

The classic draw poker machine has been modified to use Jokers as wild cards or to use Deuces (or even other cards) as wild cards. "Jokers Wild" and "Deuces Wild" draw poker still display to the player a single five card hand and allow the player to discard unwanted cards and receive replacement cards. The payout table is modified to recognize the differing odds for achieving various poker hands when wild cards are involved. Furthermore, different poker hand rankings are used in the pay table to recognize different winning combinations that can be achieved using wild cards.

U.S. Pat. No. 5,356,140 (Dabrowski et al.) (the disclosure of which is incorporated herein by this reference) discloses a method of play of a game generally referred to as "Double Poker". In this method of play, a player makes a wager to participate in the game and the player is dealt two distinct hands at the beginning of the game. Each hand is dealt from its own separate complete deck of cards and all five cards in each hand are dealt face up. The player selects one of the hands to play and the unselected hand is voided or removed from use. The player plays out the selected hand according to the conventional manner of play of traditional video poker games by discarding and receiving replacement cards. All replacement cards are dealt from the particular initial deck of cards from which the first five cards were dealt. The player wins or loses based on a payout schedule applied to preselected winning hand combinations and based on the number of coins wagered by the player.

The method of play disclosed in this '140 patent has the drawback that the player only has two initial five cards hands to choose from and all five cards of each hand are displayed to the player. The player makes a single wager and can only play one of the hands. Thus, if the player were to receive good hands on the initial deal of both hands, one of the good hands would be unavailable to the player and therefore would be wasted.

U.S. Pat. No. 5,823,873 (Moody) (the disclosure of which is incorporated herein by this reference) describes an electronic video gaming machine and method in which the player may play multiple hands at the same time. The player makes a wager for each separate hand to be played by the player. One hand of five cards is dealt all face up. The player selects none, one or more of the face up cards from the first hand as cards to be held. The cards that are held are duplicated from the first hand into all of the other hands. Replacement cards for the non-selected cards are dealt into the first hand and additional cards are then dealt to the first hand, if needed, so that the first hand has five cards. Additional cards are also dealt to all of the other hands so that each hand is a five card hand. The poker hand ranking of each five card hand is determined row by row. The player is then paid for any winning poker hands based on a pay table and the amount of the player's wager.

The method of play disclosed in this '873 patent has the drawback that the player must select a single video poker format to play at the beginning of each hand. For example, if the player selects to play Deuces Wild Poker, each hand is the Deuces Wild Poker format. Also any cards that are selected to be held in the first hand are duplicated into all of the other hands that the player has wagered to play. Thus the player cannot play his hands differently in an attempt to achieve different ending hands. For example, if the player were dealt Three Aces and two Fives (a Full House) in the first initial five cards, the player cannot hold the Full House in one hand and hold only the three Aces in any of the other hands in order to attempt to achieve Four Aces on the draw while at the same time guaranteeing a good return on the round of play since at least one Full House will be won by the player.

U.S. Pat. No. 5,816,915 (Kadlic) (the disclosure of which is incorporated herein by this reference) discloses an electronic video draw poker machine and method in which a four separate five card draw poker hands are displayed at the same time. The initial deal of each five card hand is two cards face up and three cards face down. The player selects one of the sets of two face up cards to continue play. After the player has selected which set of two face up cards he wishes to play, the remaining face down cards in the selected hand are revealed. The game then continues in the conventional manner with the player discarding and drawing replacement cards with respect to the selected five card hand in an attempt to improve that hand. After the draw step is completed, the final five card hand is compared to a pay table based on poker hand ranking to determine if the player has achieved a winning combination. The amount of the payout to the player for a winning combination is based on the number of coins, tokens or credits wagered by the player and the type of winning hand achieved.

The method of play disclosed in this '915 patent also has the drawback that the player must select a single video poker format to play at the beginning of each hand. For example, if the player selects to play Double Bonus Poker, each hand is the Double Bonus Poker format. If the player has two or more good starting hands, only one of the starting hands can be used and the other good starting hands are wasted.

Video Poker has undergone many changes and adaptations in gaming today. Those changes include offering players a selection of poker game formats (Jacks or Better Draw Poker, Bonus Poker, Double Bonus Poker, Double Double Bonus Poker, Deuces Wild Poker, Jokers Wild Poker, etc). Players indicate their choice of the poker game format that the player wishes to play and the player then makes his wager based on upon that choice of poker game format.

One of the advantages of the latest design wave of the modern electronic video poker gaming machines is that they offer multiple choices of video poker game formats on a menu video screen. This allows a player to sit at one single machine and change video poker game formats without having to go to some other machine to play a different video poker game format. Players like this choice of multiple video poker game formats as evidenced by the prolific growth in numbers of these menu type electronic video poker gaming machines in many gaming locations over the last few years.

What is needed is a video poker gaming machine that would expand upon the present technology of these types of gaming machines and allow even more freedom of choice to players. That is what the present invention will do for players.

Presently, players are allowed to play only one video poker game format at any particular time. This limitation has been enhanced somewhat by the video poker gaming machines that offer multiple hand games so that a player has a variable choice as to the number of hands the player wishes to wager upon during any particular round of the game. Presently, a player selects his choice of video poker game format and, then, a player indicates how many of such hands he wants to wager upon.

It is an object of the present invention to provide a new form of an electronic video poker game that allows the player to play two or more video poker game formats at the same time.

It is a feature of the present invention to provide an electronic video poker machine that has a multi-hand screen display and that allows the player to select from a plurality of video poker game formats for each of the hands displayed on the screen. The player may also select to wager from one unit to the maximum number of units separately on each of the hands.

It is an advantage of the present invention that the player is given multiple options at the beginning of each round of the game to select which video poker game format the player wishes to play on each of a plurality of hands and the player is given the option to determine separately how many units the player wishes to wager on each of the multiple hands that the player has chosen to play.

Other objects, features and advantages of the present invention will become apparent from a consideration of the following detailed description.

SUMMARY OF THE INVENTION

The present invention is a card game preferably played on an electronic video gaming machine in which a single player plays against a pay table. The player makes a wager for each of two or more hands that the player wishes to play. The player selects a poker hand format for each hand, with no two hands having the same poker hand format. After the player has made his wagers and selected the poker hand format for each hand, the computer controls deal out face up each initial five card hand of poker in each poker format selected by the player. The player selects none, one or more of the face up cards from each hand as cards to be held. The non-selected cards are discarded from each first hand and replacement cards are dealt face for each discarded card. The poker hand ranking of the resulting final five cards of each hand are then determined. The player is then paid a preestablished amount based on the amount of each wager if the resulting cards of each hand comprise a predetermined poker hand ranking.

DETAILED DESCRIPTION OF THE PREFERRED EMBODIMENTS

The method and apparatus of the present invention improves upon existing electronic video poker gaming machines in that a player is allowed to indicate before each round of play begins how many different hands the player wishes to play, which video poker game format the player wishes each hand to be and how many units the player wishes to wager on each particular hand. For example:

a) Player selects how many hands he wishes to play at one time: eg. Player chooses to play four hands.

b) Player selects how many units he wants to wager on each hand: eg. Player bets 2 units on HAND ONE, 3 units on HAND TWO, 4 units on HAND THREE and 5 units on HAND FOUR.

c) Player selects the video poker game format for each hand: eg. Player chooses "Jacks or Better" for HAND ONE; Player chooses "Bonus Poker" for HAND TWO; Player chooses "Deuces Wild" for HAND THREE; and Player chooses "Jokers Wild Poker" for HAND FOUR.

Figure 1:
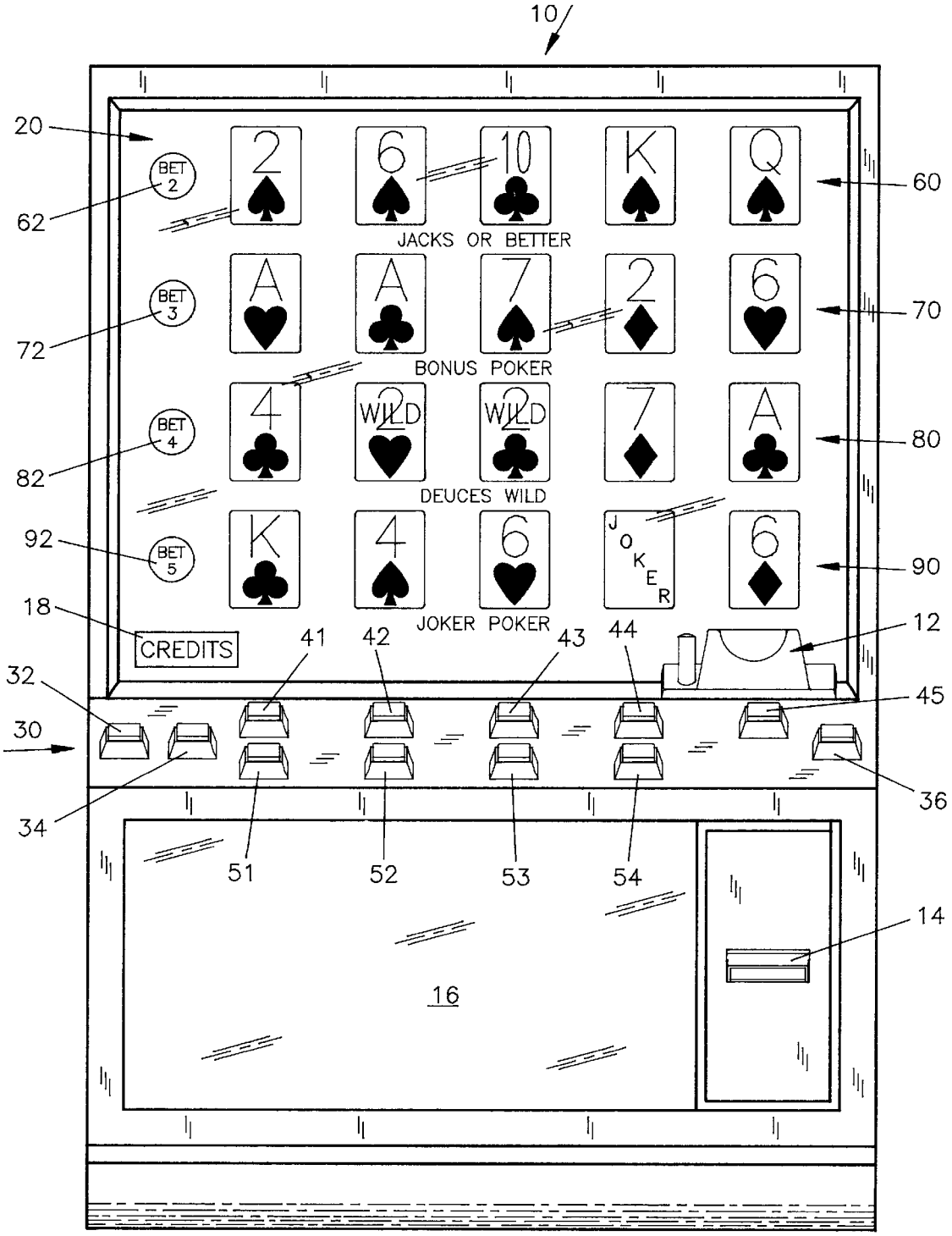
FIG. 1 shows a representative electronic video gaming machine of the present invention including a typical screen display used in the method of play of the present invention after the initial deal of the cards.

FIG. 1 shows generally at 10 a typical electronic video gaming machine that is configured to offer to the player the method of the present invention. The electronic video gaming machine 10 includes a conventional coin head 12 into which the player can insert coins or gaming tokens and a slot 14 which leads to a conventional bill acceptor mounted on the interior of the gaming machine and into which the player can insert paper currency. The use of coins, tokens or paper currency is the mechanism by which the player wagers on the poker hands the player wishes to play. As is also conventional in electronic video gaming machines, a credit meter display 18 is provided to show the amount of credits that the player has accrued on the gaming machine 10—either by inserting coins, tokens or paper currency or from winning plays achieved by the player. Whenever the player makes a wager, the amount of the wager is decremented from the credit meter display 18. Whenever the player achieves a winning play during the play of the game, the amount of the winning play is incremented on the credit meter display 18.

A conventional payout hopper is also located on the interior of the gaming machine and is used to dispense coins or tokens to the player into a payout tray 16 when the player wishes to collect any winning amounts the player has accrued. Other suitable and conventional payout mechanisms can be used, such as a ticket printer or other cashless payout devices.

The gaming machine 10 also includes a video screen display 20 of any suitable type upon which representations of playing cards are displayed. In a preferred embodiment of the present invention, two or more hands, preferably four hands, are displayed on the video screen display 20 at the same time. As shown in FIG. 1, four hands are displayed: HAND ONE 60, HAND TWO 70, HAND THREE 80 and HAND FOUR 90. Each hand would preferably have five card locations preferably from left to right in a horizontal row, although other manners of displaying multiple hands can be used. The video screen display 20 also contains a location at which the amount wagered on each hand is shown, for example, wager location 62 is associated with HAND ONE 60, wager location 72 is associated with HAND TWO 70, wager location 82 is associated with HAND THREE 80 and wager location 92 is associated with HAND FOUR 90.

A button panel 30 is also provided on the gaming machine 10 and the buttons mounted on the button panel 30 are used by the player to control the operation of the gaming machine 10. Any suitable configuration of the buttons on the button panel can be used and, alternatively, conventional touch screen technology can be used for any or all of the buttons mounted on the button panel.

A typical button arrangement is shown on the button panel 30 in FIG. 1. A "BET ONE" button 32 is provided to allow the player to wager one credit at a time. A "BET MAX" button 34 is provided to allow the player to wager the maximum amount of credits permitted by the configuration of the gaming machine 10. Any number of credits can be set as the maximum amount that it is possible to wager on each hand and, typically, five credits will be the maximum number of credits for any particular hand.

A conventional "DEAL/DRAW" button 36 is also provided on the button panel 30 which is used by the player to activate the initial deal of the cards at the deal stage of the method of play or the dealing of replacement cards at the draw stage of the method of play as is appropriate.

The button panel 30 is also provided with five "CARD" buttons 41–45 associated with each horizontal card location on the video screen display: card button 41 is associated with the left most card location, card button 42 is associated with the second from the left card location, card button 43 is associated with the middle card location, card button 44 is associated with the second from the right card location and card button 45 is associated with the right most card location. Each card button 41–45 is preferably aligned below the card locations so that the player can easily associate the appropriate card button with the appropriate card location.

Finally on the button panel 30 and below the card buttons 41–45 are four "HAND" buttons 51–54 associated with each of the four hands shown on the video display screen 20: hand button 51 is associated with "HAND ONE" 60, hand button 52 is associated with "HAND TWO" 70, hand button 53 is associated with "HAND THREE" 80 and hand button 54 is associated with "HAND FOUR" 90. In one embodiment of the present invention, each of the poker game formats is associated with each "HAND" button and the player presses the HAND button to select the game format for that hand. By pressing the HAND button, the player can toggle through all of the poker game format selections and choose the poker game format that the player desires for that hand. The poker game format is displayed just beneath each hand on the video screen display 20 and changes each time the player presses the HAND button. In another embodiment, touch screen technology would be used and the player simply presses the video screen display 20 at the location that the name of the video game format is shown to cause the video game format to toggle to the next type of game until the player has selected the video game format desired. Finally, any other suitable video game format selection technology can be used, such as a light pen or other suitable pointing device.

The method of play of the present invention will now be described. After the player has inserted an appropriate amount of coins, tokens or paper currency to add a sufficient amount of credits on the credit display meter 18, the player makes his initial wagers. The player may merely press the "BET MAX" button 34 and the maximum number of credits are applied to each hand, for example, five credits would be wagered on each of the four hands for a total wager of twenty credits.

Alternatively, the player may make separate wagers on each hand. To do this, the player first presses hand button 51 for HAND ONE 60 and then the player presses the "BET ONE" button 32 the desired number of times to wager on HAND ONE 60. As shown in FIG. 1, the player has wagered two credits on HAND ONE 60 and this is shown in the wagering location 62 associated with HAND ONE 60.

The player then presses hand button 52 for HAND TWO 70 and then the player presses the "BET ONE" button 32 the desired number of times to wager on HAND TWO 70. As shown in FIG. 1, the player has wagered three credits on HAND TWO 70 and this is shown in the wagering location 72 associated with HAND TWO 70.

The player then presses hand button 53 for HAND THREE 80 and then the player presses the "BET ONE" button 32 the desired number of times to wager on HAND THREE 80. As shown in FIG. 1, the player has wagered four credits on HAND THREE 80 and this is shown in the wagering location 82 associated with HAND THREE 80.

Finally, the player then presses hand button 54 for HAND FOUR 90 and then the player presses the "BET ONE" button 32 the desired number of times to wager on HAND FOUR 90. As shown in FIG. 1, the player has wagered five credits on HAND FOUR 90 and this is shown in the wagering location 82 associated with HAND FOUR 90. Alternatively, the player could press the "BET MAX" BUTTON 34 to wager five credits on HAND FOUR 90.

The method of the present invention allows the player to select a poker hand format for each hand that the player wishes to play. The are many variations of poker that can be played on an electronic video poker gaming machine and the player can be offered a myriad of these formats from which the player can select for each of his hands for which wagers have been made. Each format is provided with a suitable pay table which shows the payouts available to the player for various winning hand combinations The classic poker hand format is Jacks or Better Draw Poker. A suitable pay table for Jacks or Better Draw Poker is shown in Table 1:

TABLE 1

| JACKS OR BETTER DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |

TABLE 1-continued

| JACKS OR BETTER DRAW POKER | NUMBER OF COINS BET | | | | |
|---|---|---|---|---|---|
| POKER HAND | 1 | 2 | 3 | 4 | 5 |
| TWO PAIR | 2 | 4 | 6 | 8 | 10 |
| JACKS OR BETTER | 1 | 2 | 3 | 4 | 5 |

The pay table shown in Table 1 is the preferred pay table for Jacks or Better Draw Poker for the method of the present invention, but any suitable pay table can be used.

Another poker hand format is Bonus Draw Poker. In Bonus Draw Poker, special payouts are provided for different ranks of Four-of-a-Kinds. A suitable pay table for Bonus Draw Poker is shown in Table 2:

TABLE 2

| BONUS DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2'S, 3'S OR 4'S | 40 | 80 | 120 | 160 | 200 |
| FOUR 5'S THRU KINGS | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

The pay table shown in Table 2 is the preferred pay table for Bonus Draw Poker for the method of the present invention, but any suitable pay table can be used.

Another poker hand format is Double Bonus Draw Poker. In Double Bonus Draw Poker, special payouts are provided for different ranks of Four-of-a-Kinds. A suitable pay table for Double Bonus Draw Poker is shown in Table 3:

TABLE 3

| DOUBLE BONUS DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2'S, 3'S OR 4'S | 40 | 80 | 120 | 160 | 200 |
| FOUR 5'S THRU KINGS | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

The pay table shown in Table 3 is the preferred pay table for Double Bonus Draw Poker for the method of the present invention, but any suitable pay table can be used.

Another poker hand format is Triple Bonus Draw Poker. In Triple Bonus Draw Poker, special payouts are provided for different ranks of Four-of-a-Kinds. A suitable pay table for Triple Bonus Draw Poker is shown in Table 4:

TABLE 4

| TRIPLE BONUS DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 240 | 480 | 720 | 960 | 1200 |
| FOUR 2'S, 3'S OR 4'S | 40 | 80 | 120 | 160 | 200 |
| FOUR 5'S THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

The pay table shown in Table 4 is the preferred pay table for Triple Bonus Draw Poker for the method of the present invention, but any suitable pay table can be used.

Another poker hand format is Double Double Bonus Draw Poker. In Double Double Bonus Draw Poker, special payouts are provided for different ranks of Four-of-a-Kinds and other special payouts are provided for certain Four-of-a-Kinds when achieved with certain other cards. A suitable pay table for Double Double Bonus Draw Poker is shown in Table 5:

TABLE 5

| DOUBLE DOUBLE BONUS POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES WITH ANY 2, 3 OR 4 | 400 | 800 | 1200 | 1600 | 2000 |
| FOUR 2'S, 3'S OR 4'S WITH ANY ACE, 2, 3 OR 4 | 160 | 320 | 480 | 640 | 800 |
| FOUR ACES | 160 | 320 | 480 | 640 | 800 |
| FOUR 2'S, 3'S OR 4'S | 80 | 160 | 240 | 320 | 400 |
| FOUR 5'S THRU KINGS | 50 | 100 | 150 | 200 | 250 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

The pay table shown in Table 5 is the preferred pay table for Double Double Bonus Draw Poker for the method of the present invention, but any suitable pay table can be used.

Another poker hand format is Joker's Wild Draw Poker. In Jokers Wild Draw Poker, a Joker is added to the standard fifty-two card deck to create a fifty-three card deck. When the Joker appears in the player's hand, the Joker is treated as a wild card. Joker's Wild Draw Poker allows other winning combinations that include wild cards to be used such as a Five-of-a-Kind and a Wild Royal Flush. A suitable pay table for Jokers Wild Draw Poker is shown in Table 6:

TABLE 6

| JOKERS WILD DRAW POKER | NUMBER OF COINS BET | | | | |
|---|---|---|---|---|---|
| POKER HAND | 1 | 2 | 3 | 4 | 5 |
| ROYAL FLUSH WITHOUT JOKER | 800 | 1600 | 2400 | 3200 | 8000 |
| FIVE-OF-A-KIND | 200 | 400 | 600 | 800 | 1000 |

TABLE 6-continued

| JOKERS WILD DRAW POKER | NUMBER OF COINS BET | | | | |
|---|---|---|---|---|---|
| POKER HAND | 1 | 2 | 3 | 4 | 5 |
| WILD ROYAL FLUSH (WITH JOKER) | 50 | 100 | 150 | 200 | 250 |
| STRAIGHT FLUSH | 50 | 100 | 150 | 200 | 250 |
| FOUR-OF-A-KIND | 15 | 30 | 45 | 60 | 75 |
| FULL HOUSE | 5 | 10 | 15 | 20 | 25 |
| FLUSH | 4 | 8 | 12 | 16 | 20 |
| STRAIGHT | 3 | 6 | 9 | 12 | 15 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

The pay table shown in Table 6 is the preferred pay table for Jokers Wild Draw Poker for the method of the present invention, but any suitable pay table can be used.

Another poker hand format is Double Jokers Wild Draw Poker. In Double Jokers Wild Draw Poker, two Jokers are added to the standard fifty-two card deck to create a fifty-four card deck. When one or both of the Jokers appears in the player's hand, each Joker is treated as a wild card. Double Jokers Wild Draw Poker allows other winning combinations that include wild cards to be used such as a Five-of-a-Kind and a Wild Royal Flush. A suitable pay table for Double Jokers Wild Draw Poker is shown in Table 7:

TABLE 7

| DOUBLE JOKERS WILD DRAW POKER | NUMBER OF COINS BET | | | | |
|---|---|---|---|---|---|
| POKER HAND | 1 | 2 | 3 | 4 | 5 |
| ROYAL FLUSH WITHOUT JOKER | 500 | 1000 | 1500 | 2000 | 4780 |
| FIVE-OF-A-KIND | 50 | 100 | 150 | 200 | 250 |
| WILD ROYAL FLUSH (WITH JOKER) | 100 | 200 | 300 | 400 | 500 |
| STRAIGHT FLUSH | 25 | 50 | 75 | 100 | 125 |
| FOUR-OF-A-KIND | 6 | 12 | 18 | 24 | 30 |
| FULL HOUSE | 5 | 10 | 15 | 20 | 25 |
| FLUSH | 4 | 8 | 12 | 16 | 20 |
| STRAIGHT | 3 | 6 | 9 | 12 | 15 |
| THREE-OF-A-KIND | 2 | 4 | 6 | 8 | 10 |
| TWO PAIR | 1 | 2 | 3 | 4 | 5 |

The pay table shown in Table 7 is the preferred pay table for Jokers Wild Draw Poker for the method of the present invention, but any suitable pay table can be used.

Another poker hand format is Deuces Wild Draw Poker. In Deuces Wild Draw Poker, each of the four Deuces in the deck are designated as wild cards when one or more Deuces appears in the player's hand. Deuces Wild Draw Poker allows other winning combinations that include wild cards to be used such as a Five-of-a-Kind and a Wild Royal Flush, as well as providing a special payout for achieving all four Deuces. A suitable pay table for Deuces Wild Draw Poker is shown in Table 8:

TABLE 8

| DEUCES WILD DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| FOUR DEUCES | 200 | 400 | 600 | 800 | 1000 |
| WILD ROYAL FLUSH | 20 | 40 | 60 | 80 | 100 |
| FIVE-OF-A-KIND | 10 | 20 | 30 | 40 | 50 |

TABLE 8-continued

| DEUCES WILD DRAW POKER | NUMBER OF COINS BET | | | | |
|---|---|---|---|---|---|
| POKER HAND | 1 | 2 | 3 | 4 | 5 |
| STRAIGHT FLUSH | 10 | 20 | 30 | 40 | 50 |
| FOUR-OF-A-KIND | 4 | 8 | 12 | 16 | 20 |
| FULL HOUSE | 4 | 8 | 12 | 16 | 20 |
| FLUSH | 3 | 6 | 9 | 12 | 15 |
| STRAIGHT | 2 | 4 | 6 | 8 | 10 |
| THREE-OF-A-KIND | 1 | 2 | 3 | 4 | 5 |

The pay table shown in Table 8 is the preferred pay table for Deuces Wild Draw Poker for the method of the present invention, but any suitable pay table can be used. Alternatively, other ranks of cards can be used as the wild card other than Deuces.

Another poker hand format is Deuces Wild with One Joker Wild Draw Poker. In Deuces Wild with One Joker Wild Draw Poker, each of the four Deuces in the deck are designated as wild cards when one or more Deuces appears in the player's hand. Additionally, a Joker is added to the standard fifty-two card deck to create a fifty-three card deck. When the Joker appears in the player's hand, the Joker is also treated as a wild card. Deuces Wild with One Joker Wild Draw Poker allows other winnin combinations that include wild cards to be used such as a Five-of-a-Kind and a Wild Royal Flush, as well as providing a special payout for achieving all four Deuces. A suitable pay table for Deuces Wild with One Joker Wild Draw Poker is shown in Table 9:

TABLE 9

| DEUCES WILD WITH ONE JOKER WILD DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| FOUR DEUCES AND THE JOKER | 1000 | 2000 | 3000 | 4000 | 10000 |
| FOUR DEUCES | 25 | 50 | 75 | 100 | 125 |
| WILD ROYAL FLUSH | 12 | 24 | 36 | 48 | 60 |
| FIVE-OF-A-KIND | 9 | 18 | 27 | 36 | 45 |
| STRAIGHT FLUSH | 6 | 12 | 18 | 24 | 30 |
| FOUR-OF-A-KIND | 3 | 6 | 9 | 15 | 15 |
| FULL HOUSE | 3 | 6 | 9 | 12 | 15 |
| FLUSH | 3 | 6 | 9 | 12 | 15 |
| STRAIGHT | 2 | 4 | 6 | 8 | 10 |
| THREE-OF-A-KIND | 1 | 2 | 3 | 4 | 5 |

The pay table shown in Table 9 is the preferred pay table for Deuces Wild with One Joker Wild Draw Poker for the method of the present invention, but any suitable pay table can be used. Alternatively, other ranks of cards can be used as the wild card other than Deuces.

Another poker hand format is One Eyed Jacks Wild Draw Poker. In each deck of fifty-two standard playing cards there are two One-Eyed Jacks (the Jack of Hearts and the Jack of Spades). In One Eyed Jacks Wild Draw Poker, both of these two One-Eyed Jacks are predesignated as wild cards. When one or both of the One Eyed Jacks appears in the player's hand, each One Eyed Jack is treated as a wild card. One Eyed Jacks Wild Draw Poker allows other winning combinations that include wild cards to be used such as a Five-of-a-Kind and a Wild Royal Flush. A suitable pay table for One Eyed Jacks Wild Draw Poker is shown in Table 10:

TABLE 10

| ONE EYED JACKS WILD DRAW POKER | NUMBER OF COINS BET | | | | |
|---|---|---|---|---|---|
| POKER HAND | 1 | 2 | 3 | 4 | 5 |
| ROYAL FLUSH WITHOUT JOKER | 500 | 1000 | 1500 | 2000 | 4780 |
| FIVE-OF-A-KIND | 50 | 100 | 150 | 200 | 250 |
| WILD ROYAL FLUSH (WITH JOKER) | 100 | 200 | 300 | 400 | 500 |
| STRAIGHT FLUSH | 25 | 50 | 75 | 100 | 125 |
| FOUR-OF-A-KIND | 6 | 12 | 18 | 24 | 30 |
| FULL HOUSE | 5 | 10 | 15 | 20 | 25 |
| FLUSH | 4 | 8 | 12 | 16 | 20 |
| STRAIGHT | 3 | 6 | 9 | 12 | 15 |
| THREE-OF-A-KIND | 2 | 4 | 6 | 8 | 10 |
| TWO PAIR | 1 | 2 | 3 | 4 | 5 |

The pay table shown in Table 10 is the preferred pay table for One Eyed Jacks Wild Draw Poker for the method of the present invention, but any suitable pay table can be used.

Other poker game formats can also be used with the present invention.

As discussed above, the player now selects which poker game format the player wishes to play on each of the four hands. Using the HAND buttons 51, 52, 53 and 54 shown in FIG. 1, the player simply toggles through the poker game formats available for each hand until the poke game format desired by the player is shown on the video screen display 20 under each hand.

As shown in FIG. 1, the player has selected the format of Jacks or Better Draw Poker for HAND ONE 60, the format of Bonus Poker Draw Poker for HAND TWO 70, the format of Deuces Wild Draw Poker for HAND THREE 80 and the format of Jokers Wild Draw Poker for HAND FOUR 90.

After the player has selected the game format for each hand, the play begins by dealing an initial round of cards to each of the hands the player has indicated he wishes to play. FIG. 1 shows an example of an initial deal of five cards to each of the four hands. In HAND ONE 60, the player has received the Two of Spades, the Six of Spades, the Ten of Clubs, the King of Spades and the Queen of Spades. In HAND TWO 70, the player has received the Ace of Hearts, the Ace of Clubs, the Seven of Spades, the Two of Diamonds and the Six of Hearts. In HAND THREE 80, the player has received the Four of Clubs, the Two of Hearts, the Two of Clubs, the Seven of Diamonds and the Ace of Clubs. In HAND FOUR 90, the player has received the King of Clubs, the Four of Spades, the Six of Hearts, the Joker and the Six of Diamonds.

The player now acts upon the initial round of cards dealt to each hand by selecting the cards from each hand that the player wishes to hold. For example, in HAND ONE 60 which is Jacks or Better Draw Poker, the player would probably hold the Two of Spades, the Six of Spades, the King of Spades and the Queen of Spades in hopes of achieving a flush. In HAND TWO 70 which is Bonus Poker, the player would probably hold the Ace of Hearts and the Ace of Clubs since a Pair of Aces is already a winning hand and the player may be able to improve the hand on the draw. In HAND THREE 80 which is Deuces Wild Poker, the player would probably hold the Two of Hearts and the Two of Clubs since both of these cards are wild cards in this hand. In HAND FOUR 90, the player would probably hold the Six of Hearts, the Joker and the Six of Diamonds since the Joker is a wild card and Three-of-a-Kind is already a winning hand the player may be able to improve his hand on the draw.

Figure 2:
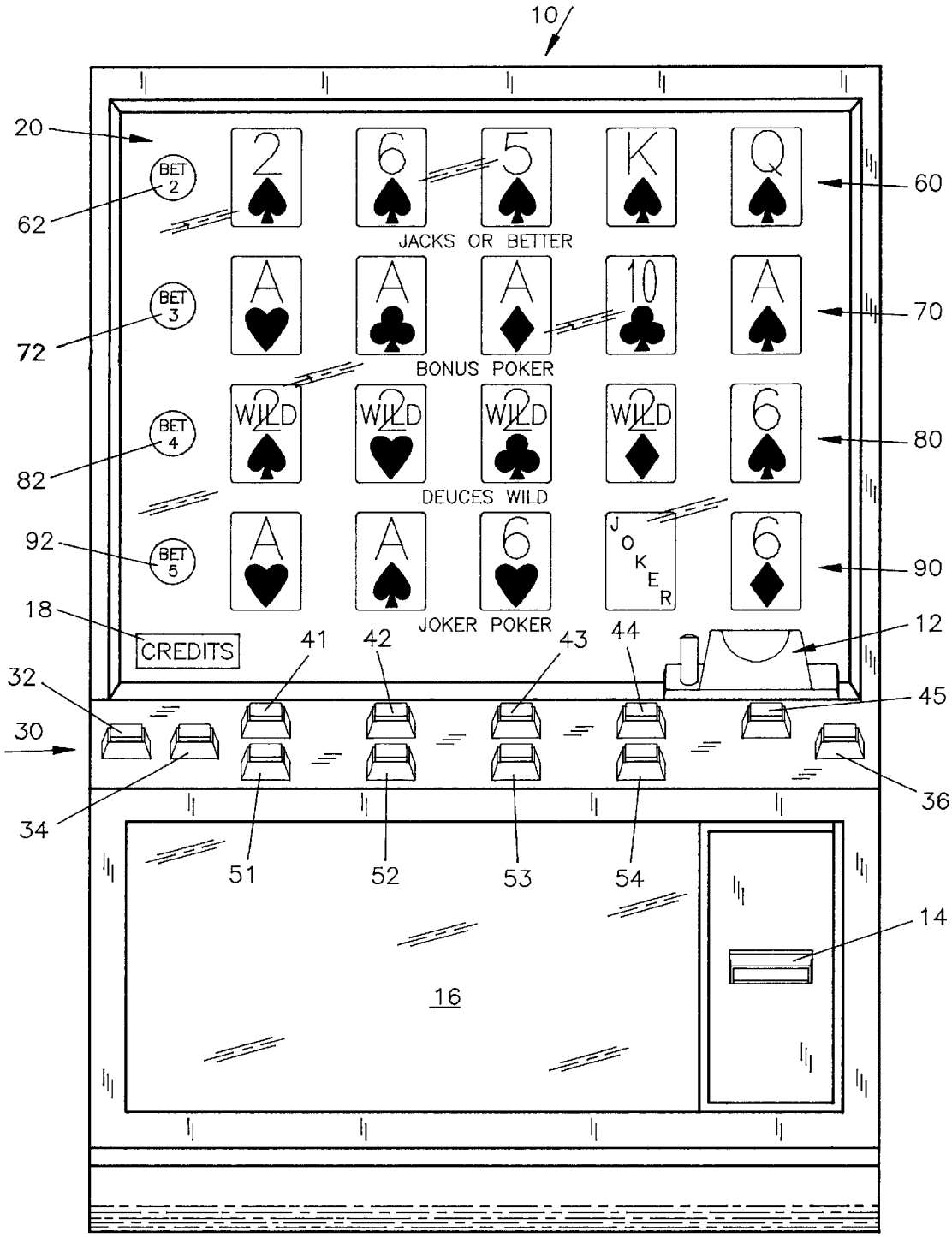
FIG. 2 shows a representative electronic video gaming machine of the present invention including a typical screen display used in the method of play of the present invention after the draw step and the dealing of replacement cards.

Replacement cards are now dealt to each hand for the cards that have been discarded. FIG. 2 shows as an example the results of the draw step of the method of the present invention. In HAND ONE 60 which is Jacks or Better Draw Poker, the player drew a Five of Spades and achieved a final hand of a Flush. The player would win ten credits for a wager of two credits.

In HAND TWO 70 which is Bonus Poker, the player drew the Ace of Diamonds and the Ace of Spades for a final hand of Four Aces. The player would win two hundred forty credits for a wager of three credits.

In HAND THREE 80 which is Deuces Wild Poker, the player drew the Two of Spades and the Two of Diamonds for a final hand of Four Deuces. The player would win eight hundred credits for a wager of four credits.

Finally, in HAND FOUR 90, the player drew the Ace of Hearts and the Ace of Spades for a final hand of a Full House. The player would win twenty-five credits for a wager of five credits. The player's total win of 1075 credits would be added to the credit meter display 18 and the gaming machine would be ready for the next round of play or the player could cash out his winnings.

One modification that may be added to the method of play in order to speed up the play of the method involves indicating which cards should be held by the player after the initial deal of the cards. After the initial cards are dealt, a "hold" symbol could be imposed on or over the cards of each hand that should be held by the player based on the mathematical probabilities. Preferably, this "autohold" suggestion that is made to the player would be according to the mathematically correct way for the player to win the most money based a long run analysis of the poker game type format of the hand being played. A player would always be given the option of overriding this play suggestion by simply touching any card, thereby disabling the "autohold" indicated by the computer controls of the gaming machine.

The method of the present invention allows a player to select poker hand formats that have the effect of changing the volatility of an overall round of play of the gaming machine. For example, in any one round of play, a player can select a hand of low volatility, eg. "Jacks or Better"; a hand of medium volatility, eg. "Bonus Poker"; a hand of high volatility, eg. "Deuces Wild"; and a hand of very high volatility, eg. Double Double Bonus Poker". The overall effect would be medium-high volatility on this round of play.

It is also possible that by choosing different wagers on different poker game formats on the same round of play, that the player is creating new volatility indices by his choices of poker game formats and wagering amounts. No present electronic video poker gaming machine offers this wide range of volatility choices to a player.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game on an electronic video gaming machine in which a single player plays against a pay table comprising:

a) dealing face up a first five card hand of poker in a first poker format;

b) dealing face up a second five card hand of poker in a second poker format different from the first poker format;

c) the player selecting none, one or more of the face up cards from the first hand as cards to be held;

d) the player selecting none, one or more of the face up cards from the second hand as cards to be held;

e) discarding from the first hand and the second hand the face up cards that were not selected to be held and replacing each of those cards with a face up card; and f) determining the poker hand ranking of the resulting cards of the first hand and the second hand.

2. The method of claim 1 including the steps of:

a) a player making a first wager on the first hand and a second wager on the second hand;

b) paying the player a preestablished amount based on the amount of the first wager if the resulting cards of the first hand comprise a predetermined poker hand ranking; and c) paying the player a preestablished amount based on the amount of the second wager if the resulting cards of the second hand comprise a predetermined poker hand ranking.

3. The method of claim 2 wherein the preestablished amount is based on a pay table for each poker hand format.

4. The method of claim 1 in which the first poker hand format and the second poker hand format are each selected from the group consisting of Jacks or Better Draw Poker, Bonus Poker, Double Bonus Poker, Triple Bonus Poker, Double Double Bonus Poker, Deuces Wild Poker, Deuces Wild with One Joker Poker, Jokers Wild Poker and Double Jokers Wild Poker.

5. A method of playing a card game on an electronic video gaming machine in which a single player plays against a pay table comprising:

a) dealing face up a first five card hand of poker in a Jacks or Better Poker format;

b) dealing face up a second five card hand of poker in a Bonus Poker format;

c) dealing face up a third five card hand of poker in a Deuces Wild Poker format;

d) dealing face up a fourth five card hand of poker in a Joker Poker format;

e) the player selecting none, one or more of the face up cards from the first hand as cards to be held;

f) the player selecting none, one or more of the face up cards from the second hand as cards to be held;

g) the player selecting none, one or more of the face up cards from the third hand as cards to be held;

h) the player selecting none, one or more of the face up cards from the fourth hand as cards to be held;

i) discarding from the first hand, the second hand, the third hand and the fourth hand the face up cards that were not selected to be held and replacing each of those cards with a face up card; and j) determining the poker hand ranking of the resulting cards of the first hand, the second hand, the third hand and the fourth hand.

6. The method of claim 5 including the steps of:

a) a player making a first wager on the first hand, a second wager on the second hand, a third wager on the third hand and a fourth wager on the fourth hand;

b) paying the player a preestablished amount based on the amount of the first wager if the resulting cards of the first hand comprise a predetermined poker hand ranking;

c) paying the player a preestablished amount based on the amount of the second wager if the resulting cards of the second hand comprise a predetermined poker hand ranking;

d) paying the player a preestablished amount based on the amount of the third wager if the resulting cards of the third hand comprise a predetermined poker hand ranking; and e) paying the player a preestablished amount based on the amount of the fourth wager if the resulting cards of the fourth hand comprise a predetermined poker hand ranking.

7. The method of claim 6 wherein the preestablished amount is based on a pay table for each poker hand format.

8. The method of claim 7 in which the pay table for the poker hand format of Jacks or Better Poker comprises:

| JACKS OR BETTER DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5. |

9. The method of claim 7 in which the pay table for the poker hand format of Bonus Poker comprises:

| BONUS DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2'S, 3'S OR 4'S | 40 | 80 | 120 | 160 | 200 |
| FOUR 5'S THRU KINGS | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5. |

10. The method of claim 7 in which the pay table for the poker hand format of Deuces Wild Poker comprises:

| DEUCES WILD DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| FOUR DEUCES | 200 | 400 | 600 | 800 | 1000 |
| WILD ROYAL FLUSH | 20 | 40 | 60 | 80 | 100 |
| FIVE-OF-A-KIND | 10 | 20 | 30 | 40 | 50 |
| STRAIGHT FLUSH | 10 | 20 | 30 | 40 | 50 |
| FOUR-OF-A-KIND | 4 | 8 | 12 | 16 | 20 |
| FULL HOUSE | 4 | 8 | 12 | 16 | 20 |
| FLUSH | 3 | 6 | 9 | 12 | 15 |
| STRAIGHT | 2 | 4 | 6 | 8 | 10 |
| THREE-OF-A-KIND | 1 | 2 | 3 | 4 | 5. |

11. The method of claim 7 in which the pay table for the poker hand format of Joker Poker comprises:

| JOKERS WILD DRAW POKER | NUMBER OF COINS BET | | | | |
|---|---|---|---|---|---|
| POKER HAND | 1 | 2 | 3 | 4 | 5 |
| ROYAL FLUSH WITHOUT JOKER | 800 | 1600 | 2400 | 3200 | 8000 |
| FIVE-OF-A-KIND | 200 | 400 | 600 | 800 | 1000 |
| WILD ROYAL FLUSH (WITH JOKER) | 50 | 100 | 150 | 200 | 250 |
| STRAIGHT FLUSH | 50 | 100 | 150 | 200 | 250 |
| FOUR-OF-A-KIND | 12 | 24 | 36 | 48 | 60 |
| FULL HOUSE | 5 | 10 | 15 | 20 | 25 |
| FLUSH | 4 | 8 | 12 | 16 | 20 |
| STRAIGHT | 3 | 6 | 9 | 12 | 15 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5. |

12. A method of playing a card game on an electronic video gaming machine in which a single player plays against a pay table comprising:

a) a player making a first wager on a first hand and a second wager on a second hand;

b) the player selecting a poker hand format for this first hand and a poker hand format for the second hand, the poker hand format of the first hand being different than the poker hand format of the second hand;

c) dealing face up five cards as the first hand;

d) dealing face up five cards as the second hand;

e) the player selecting none, one or more of the face up cards from the first hand as cards to be held;

f) the player selecting none, one or more of the face up cards from the second hand as cards to be held;

g) discarding from the first hand and the second hand the face up cards that were not selected to be held and replacing each of those cards with a face up card; and h) determining the poker hand ranking of the resulting cards of the first hand and the second hand.

13. The method of claim 12 including the steps of:

a) paying the player a preestablished amount based on the amount of the first wager if the resulting cards of the first hand comprise a predetermined poker hand ranking; and b) paying the player a preestablished amount based on the amount of the second wager if the resulting cards of the second hand comprise a predetermined poker hand ranking.

14. The method of claim 13 wherein the preestablished amount is based on a pay table for each poker hand format.

15. The method of claim 12 in which the first poker hand format and the second poker hand format are each selected from the group consisting of Jacks or Better Draw Poker, Bonus Poker, Double Bonus Poker, Triple Bonus Poker, Double Double Bonus Poker, Deuces Wild Poker, Deuces Wild with One Joker Poker, Jokers Wild Poker and Double Jokers Wild Poker.

* * * * *